US006802288B2

(12) United States Patent
Spath

(10) Patent No.: US 6,802,288 B2
(45) Date of Patent: Oct. 12, 2004

(54) DEACTIVATION HYDRAULIC VALVE LIFTER HAVING A PRESSURIZED OIL GROOVE

(75) Inventor: Mark J. Spath, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/420,240

(22) Filed: Apr. 22, 2003

(65) Prior Publication Data

US 2003/0196620 A1 Oct. 23, 2003

Related U.S. Application Data

(60) Provisional application No. 60/374,413, filed on Apr. 22, 2002.

(51) Int. Cl.[7] ..... F01L 1/34

(52) U.S. Cl. ..... 123/90.16; 123/90.55; 123/90.35; 123/198 F; 123/90.57; 123/90.12

(58) Field of Search ..... 123/90.12, 90.15, 123/90.16, 90.35, 90.38, 90.48, 90.5, 90.55, 90.57, 90.59, 198 F, 90.33, 90.58; 92/79, 24, 29, 33; 184/6.8

(56) References Cited

U.S. PATENT DOCUMENTS

| | | | | | |
|---|---|---|---|---|---|
| 4,098,240 | A | * | 7/1978 | Abell, Jr. | 123/90.55 |
| 4,228,771 | A | * | 10/1980 | Krieg | 123/90.55 |
| 4,231,267 | A | * | 11/1980 | Van Slooten | 74/569 |
| 4,463,714 | A | * | 8/1984 | Nakamura | 123/90.5 |
| 4,913,106 | A | * | 4/1990 | Rhoads | 123/90.49 |
| 4,941,438 | A | * | 7/1990 | Muto | 123/90.46 |
| 4,942,855 | A | * | 7/1990 | Muto | 123/90.33 |
| 5,245,958 | A | * | 9/1993 | Krieg et al. | 123/90.55 |
| 6,460,499 | B1 | * | 10/2002 | Mason et al. | 123/90.55 |
| 6,497,207 | B2 | * | 12/2002 | Spath et al. | 123/90.16 |
| 6,513,470 | B1 | * | 2/2003 | Hendriksma et al. | 123/90.16 |

* cited by examiner

*Primary Examiner*—Thomas Denion
*Assistant Examiner*—Kyle M. Riddle
(74) *Attorney, Agent, or Firm*—Patrick M. Griffin

(57) ABSTRACT

A deactivation hydraulic valve lifter which includes an elongate lifter body having a substantially cylindrical outer surface and an inner wall, the inner wall defining at least one annular pin chamber therein. The outer surface defining at least one annular groove in fluid communication with a high-pressure oil gallery of an engine, the lifter body having a lower end configured for engaging cam of the engine.

5 Claims, 5 Drawing Sheets

DEACTIVATION HYDRAULIC VALVE LIFTER HAVING A PRESSURIZED OIL GROOVE

RELATIONSHIP TO OTHER APPLICATIONS AND PATENTS

This application claims priority from a Provisional Patent Application, Ser. No. 60/374,413, filed Apr. 22, 2002.

TECHNICAL FIELD

The present invention relates to valve lifters for use with internal combustion engines. More particularly, to a hydraulically switchable lifter-based device, which accomplishes cylinder deactivation in push-rod engines, and most particularly to such a device having a pressurized oil groove or grooves for routing air away from the switching oil supply.

BACKGROUND OF THE INVENTION

Cylinder deactivation is the deactivation of the intake and/or exhaust valves of a cylinder or cylinders during at least a portion of the combustion process. Cylinder deactivation is a proven method, by which fuel economy can be improved. With fewer cylinders performing combustion, fuel efficiency is increased and the amount of pollutants emitted from the engine is reduced. A known method of providing cylinder deactivation in a push rod engine is by using a deactivation mechanism in the hydraulic valve lifter.

Preferably, for optimum packaging, the deactivation mechanism in a push rod engine is contained within the general envelope of a conventional hydraulic valve lifter. Such a device disclosed in commonly assigned U.S. Pat. No. 6,513,470 and incorporated herein by reference. In such a device, hydraulically operated latch pins are used to decouple concentrically disposed members of the deactivation roller hydraulic valve lifter (DRHVL). When in the decoupled mode, reciprocating motion imparted on the DRHVL via the rotating camshaft is isolated from the associated push rod and rocker arm deactivating the associated engine valve and its related cylinder.

This pumping motion, however, causes air bubbles to form in the oil surrounding the DRHVL and further causes the bubbles to be directed toward the oil supply used to switch the deactivation device from its coupled to decoupled mode. Since the decoupling event must be precisely timed to occur on demand, the presence of compressible air bubbles in the switching oil negatively impact the precision at which the DRHVL can be decoupled or decoupled.

Therefore, what is needed in the art is a device, which will shield air bubbles from entering the switching oil supply for the DRHVL. Moreover, what is needed in the art is a device that redirects the air bubbles away from the switching oil supply for the DRHVL.

SUMMARY OF THE INVENTION

A deactivation hydraulic valve lifter which includes an elongate lifter body having a substantially cylindrical outer surface and an inner wall, the inner wall defining at least one annular pin chamber therein. The outer surface defining at least one annular groove in fluid communication with a high-pressure oil gallery of an engine, the lifter body having a lower end configured for engaging a cam of the engine.

BRIEF DESCRIPTION OF THE DRAWINGS

These and other features and advantages of the invention will be more fully understood and appreciated from the following description of certain exemplary embodiments of the invention taken together with the accompanying drawings, in which.

Figure 1:
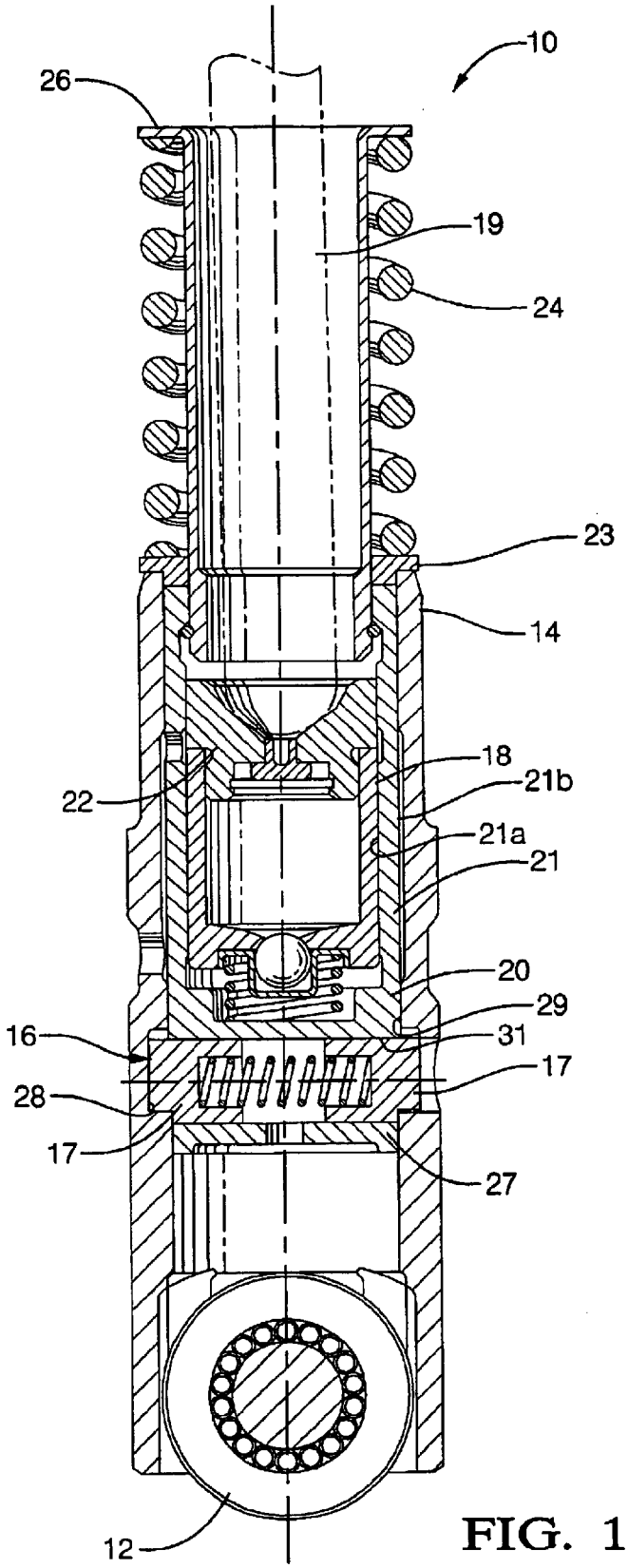
FIG. 1 is a sectioned, perspective view of the deactivation hydraulic valve lifter of the present invention.

Corresponding reference characters indicate corresponding parts throughout the several views. The exemplification's set out herein illustrate the preferred embodiments of the invention, in one form, and such exemplification's are not to be construed as limiting the scope of the invention in any manner.

DESCRIPTION OF THE PREFERRED EMBODIMENTS

Referring now to the drawings and particularly to FIG. 1, there is shown DRHVL 10 as disclosed in the referenced U.S. Pat. No. 6,513,470. DRHVL 10 includes roller 12, lifter body 14, deactivation pin assembly 16, plunger assembly 18, pin housing 20, pushrod seat assembly 22, spring seat 23, lost motion spring 24, and spring tower 26.

Plunger assembly 18 is disposed concentrically within pin housing 20, which, in turn, is disposed concentrically within lifter body 14. Pushrod seat assembly 22 is disposed concentrically within pin housing 20 above plunger assembly 18 to receive pushrod 19. Roller 12 is associated with lifter body 14. Roller 12 rides on the cam of an internal combustion engine and is displaced thereby. Roller 12 translates the rotary motion of the cam to an axial motion of lifter body 14. Deactivation pin assembly 16 normally engages annular chamber 28 disposed in inner wall 29 of lifter body 14, thereby transferring the vertical reciprocation of lifter body 14 to pin housing 20 and, in turn, to plunger assembly 18 and pushrod seat assembly 22. In this engaged position, the vertical reciprocation of DRHVL 10 opens and closes a valve of the internal combustion engine.

Pin housing 20 includes substantially cylindrical wall 21 and bottom 27. Pin wall 21 further includes inner surface 21*a* and outer surface 21*b*. Pin bottom 27 further includes radial pin bore 31. In its deactivation mode, pin assembly 16 disengages from lifter body 14 to decouple pin housing 20 from lifter body 14, and, in turn, decoupes plunger assembly 18 and pin housing 20 from the axial reciprocation of lifter body 14. Thus, when pins 17 of deactivation pin assembly 16 are in the disengaged position (displaced toward one another), only lifter body 14 undergoes axial reciprocation.

Figure 2:
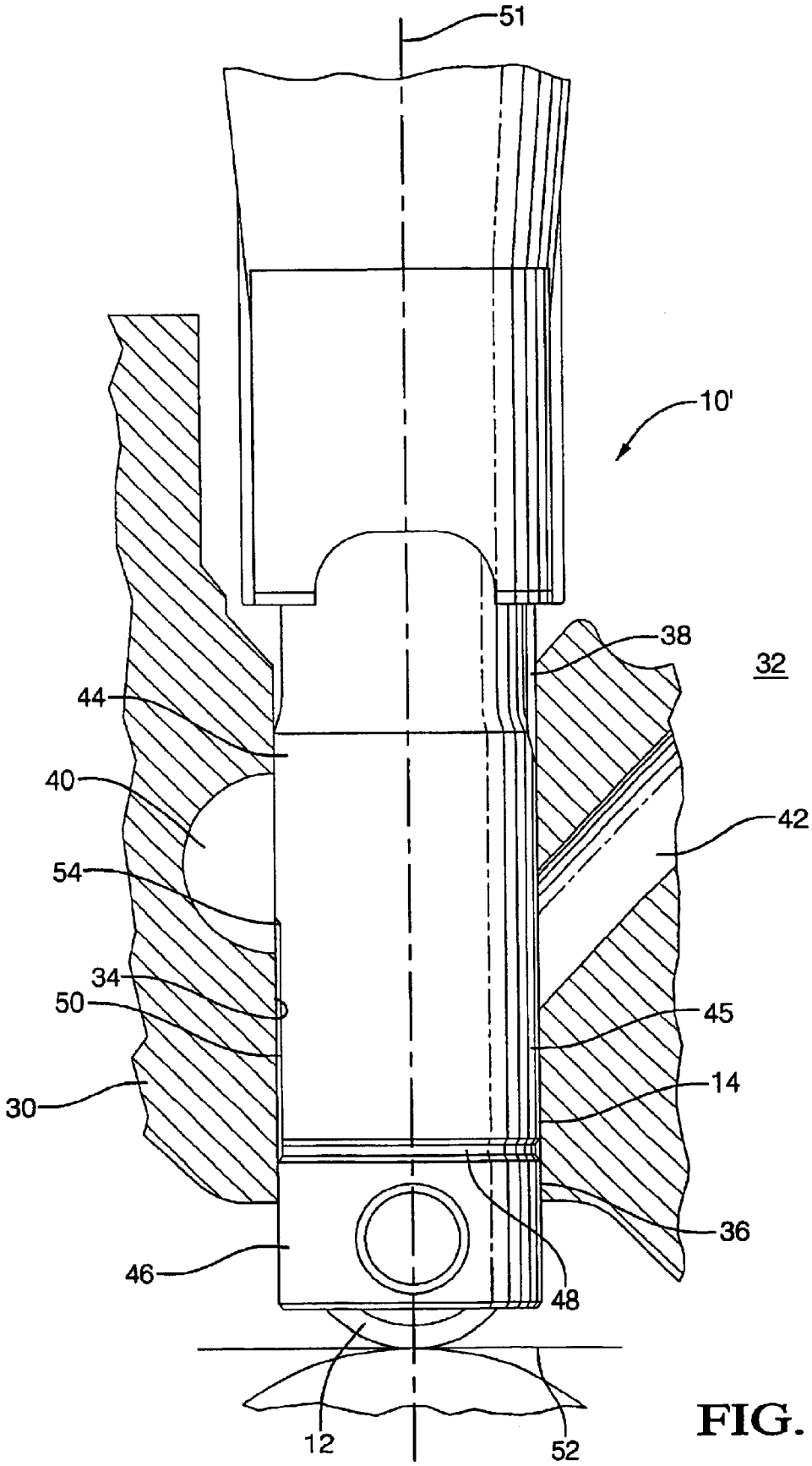
FIG. 2 is a partially sectioned view of one embodiment of the lifter body shown in FIG. 1, assembled in an engine block and with the lifter shown in the base circle cam position.

Referring to FIG. 2, there is shown DRHVL 10', having deactivation features as generally described above, installed in engine block 30 of internal combustion engine 32. The view shown in FIG. 2 shows only one DRHVL. However, it is understood that an engine may include several DRHVLs, the number corresponding to the number of valves that are deactivatable.

Block 30 defines lifter bore 34 for slidably receiving generally cylindrical body 14 of DRHVL 10'. The diametrical surface of cylindrical bore 34 is substantially continuous from its first end 36 to its second end 38. Engine oil gallery 40 fluidly connects with the surface of cylindrical bore 34 and is in fluid connection with the lubrication system of the engine. Under normal operating conditions of the engine, oil is supplied to gallery 40 in the range of 10–75 psi pressure. Switching oil passage 42 also fluidly connects with the surface of cylinder bore 34 and is in fluid connection with a switch (not shown) that controllably directs engine oil to DRHVL 10' to move pins 17 toward one another and thus to decouple lifter body 14 from pin housing 20. The pressure of the oil directed by the control switch to decouple DRHVL 10' is in the range of 25–75 psi.

Referring again to FIG. 2, body 14 of DRHVL 10' of the present invention defines outer surface 45, a first body end 46, second body end 44 and annular groove 48 proximate first body end 46. Annular groove 48 has a lower edge (not referenced) that is spaced a predetermined distance from the first body end 46 of lifter body 14. Outer surface 45 of lifter body 14 further defines channel 50. Channel 50 is oriented parallel to longitudinal axis 51 of DRHVL 10' and is in fluid connection with groove 48 terminating short of second body end 44 of body 14. Channel 50 may be, for example, a flat, machined in surface in body 14. The depth of channel 50, measured from outer surface 45, is approximately equal to the depth of groove 48.

Figure 3:
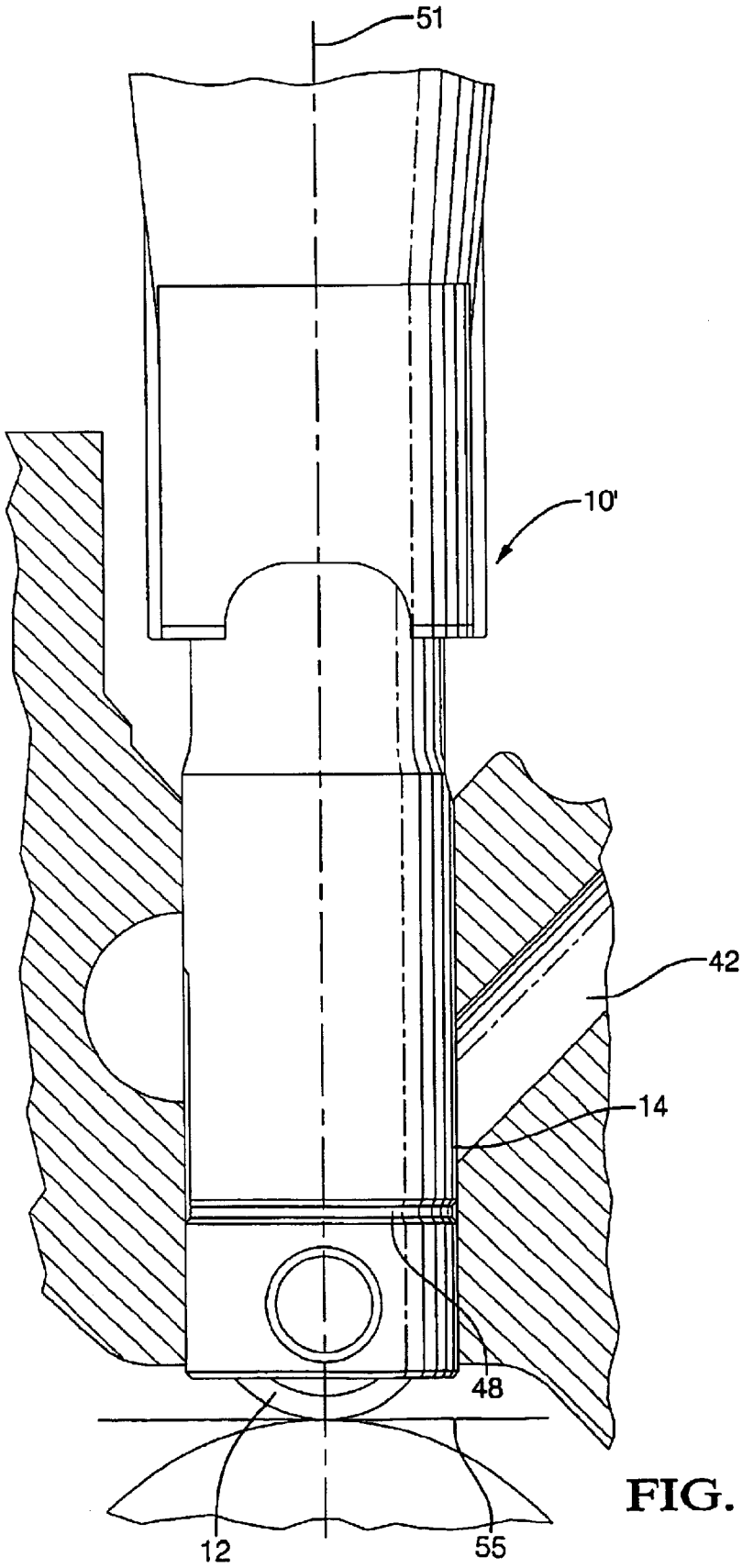
FIG. 3 is a partially sectioned view of one embodiment of the lifter body shown in FIG. 1 assembled in an engine block and with the lifter shown in the high lift cam position.

When roller 12 is in contact with the base circle of the camshaft represented by line 52 (FIG. 2), the location of annular groove 48 in body 14 is such that annular groove 48, never lines up or extends past first bore end 36 of bore 34. Also, when roller 12 is in contact with-the base circle of the cam shaft, the terminus point 54 of channel 50 remains in fluid communication with oil gallery 40. FIG. 3 depicts DRHVL 10' when roller 12 is in contact with the high lift portion of the camshaft represented by arc 55. As shown in this position, the location of annular groove 48 in body 14 is such that annular groove 48 never lines up or extends into switching oil passage 42. Also, channel 50 remains in fluid communication with oil galley 40.

In use, lifter body 14 is reciprocated in a generally axial direction by rotary motion of a cam lobe of the camshaft associated with DRHVL 10. As lifter body 14 is moved by roller 12 it is displaced in a direction toward switching oil supply channel 42. The force applied to roller 12 by the cam lobe also displaces lifter body 14 in a generally radial direction within the lifter bore 34 of engine 32 and toward oil gallery 40. Thus, a small gap is created between lifter body 14 and lifter bore 34 at first bore end 36 during the lift event. Fluid, such as air, is drawn or flows into this gap. As lifter body 14 moves axially in the other direction, lifter body 14 is again displaced in a generally radial, but opposite direction within bore 34. At least some of the volume of air or other fluid that was drawn into lifter bore 34 at first bore end 36 during the lift event is trapped within the lifter bore 34 and is pumped or displaced upward toward switching channel 42. The trapped air, if allowed to advance in this direction, in the form of air bubbles, would enter switching channel 42 where the air would mix with the oil therein. As a result, substantially higher fluid flow and time would be required in order to compress the air ladened fluid for disengagement or uncompress the air laden fluid for re-engagement of deactivation pins 17. Such a condition would render the operation of deactivation pin assembly 16, and the coupling and decoupling of the DRHVL, less reliable and precise.

Annular groove 48, in conjunction with channel 50 and oil gallery 40, remedies this problem. Pressurized oil contained in annular groove 48 and received from oil gallery 40 acts as a fluid seal and redirects the air bubbles downward and away from switching channel 42. Because annular groove 48 remains in fluid communication with oil gallery 40 at all times, a continuous ring of oil is maintained at a relatively high pressure and serves to prevent air bubbles from getting past the annular groove and reaching switching channel 42.

Figure 4:
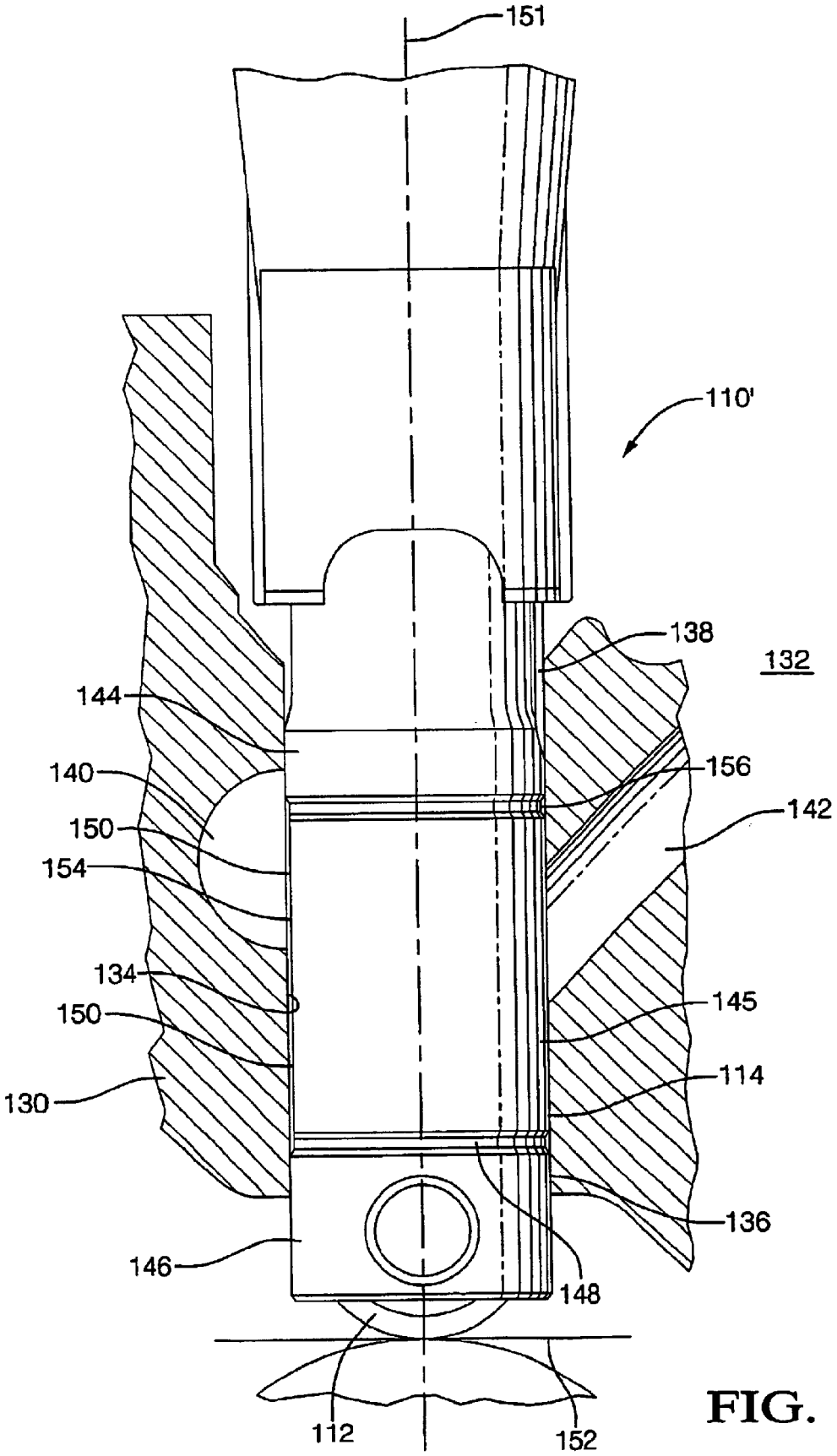
FIG. 4 is a partially sectioned view of another embodiment of the lifter body shown in FIG. 1, assembled in an engine block and with the lifter shown in the base circle cam position.
Figure 5:
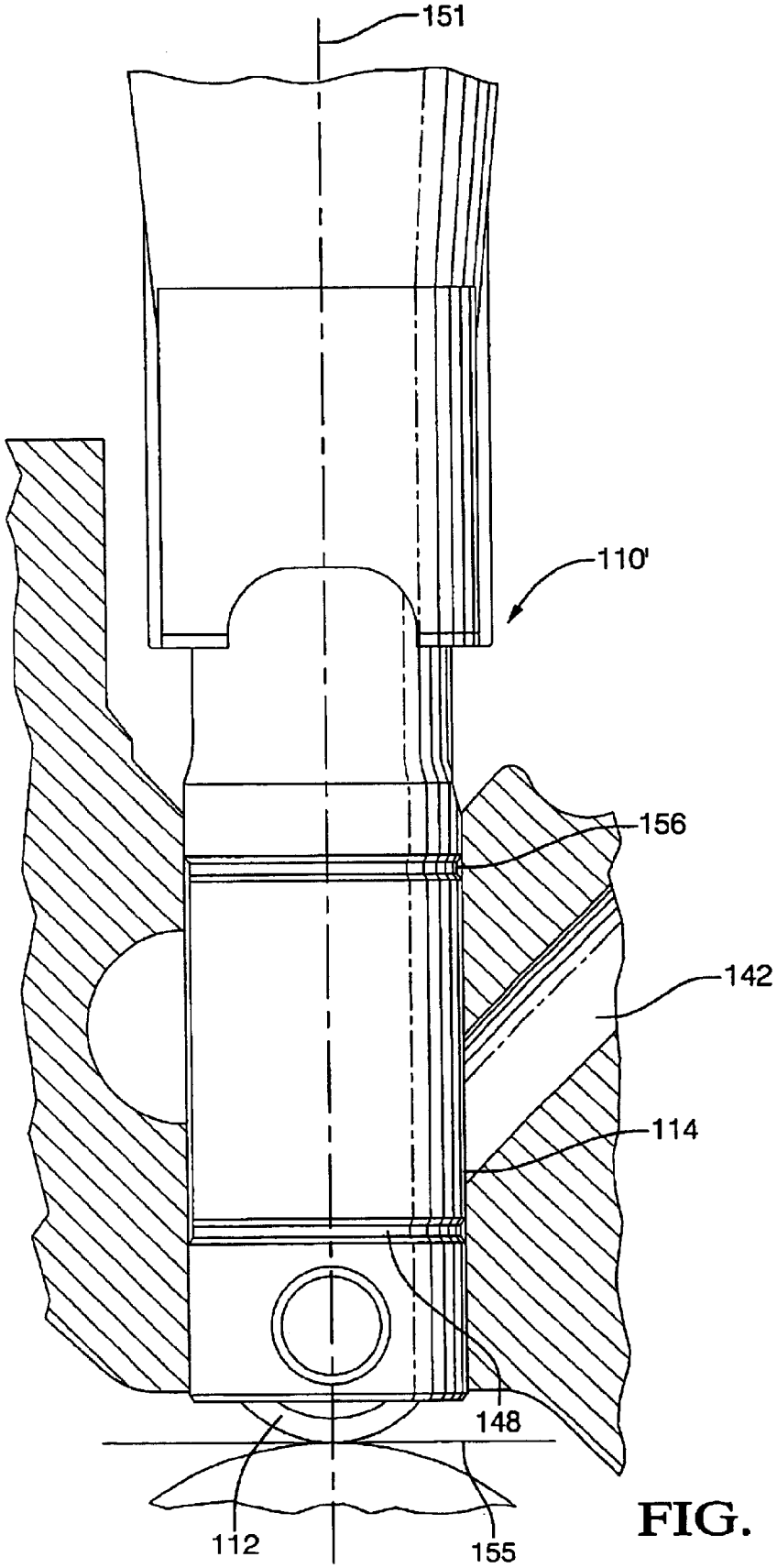
FIG. 5 is a partially sectioned view of another embodiment of the lifter body shown in FIG. 1 assembled in an engine block and with the lifter shown in the high lift cam position.

Another embodiment, is shown in FIG. 4 and FIG. 5. Included in this other embodiment is a second pressurized annular groove 156 is added in the surface of body 114 proximate second body end 144 of body 114. Second annular groove 156 acts in a similar manner to annular groove 148. Air bubbles entering second end 138 of bore 134 due to the radially-displaced action of lifter body 114 would be redirected away from switching channel 142 by the continuous ring of oil, maintained at a relatively high pressure, in annular groove 156.

Referring to FIG. 4, there is shown DRHVL 110', having deactivation features as generally described above, installed in engine block 130 of internal combustion engine 132. The view shown in FIG. 4 shows only one DRHVL. However, it is understood that an engine may include several DRHVLs, the number corresponding to the number of valves that are deactivatable.

Block 130 defines lifter bore 134 for slidably receiving generally cylindrical body 114 of DRHVL 110'. The diametrical surface of cylindrical bore 134 is substantially continuous from its first end 136 to its second end 138. Engine oil gallery 140 fluidly connects with the surface of cylindrical bore 134 and is in fluid connection with the lubrication system of the engine. Under normal operating conditions of the engine, oil is supplied to gallery 140 in the range of 10–75 psi pressure. Switching oil passage 142 also fluidly connects with the surface of cylinder bore 134 and is in fluid connection with a switch (not shown) that controllably directs engine oil to DRHVL 110' to move pins 117 toward one another and thus to decouple lifter body 114 from pin housing 120. The pressure of the oil directed by the control switch to decouple DRHVL 110' is in the range of 25–75 psi.

Referring again to FIG. 4, body 114 of DRHVL 110' of the present invention defines outer surface 145, a first body end 146, second body end 144 and annular grooves 148 and 156 proximate first body end 146 and second body end 144. Annular grooves 148 and 156 have a lower edges (not referenced) which are spaced at predetermined distances from the first body end 146 and second body end 144 of lifter body 114. Outer surface 145 of lifter body 114 further defines channel 150. Channel 150 is oriented parallel to longitudinal axis 151 of DRHVL 110' and is in fluid connection with grooves 148 and 156. Channel 150 may be, for example, a flat, machined in surface in body 114. The depth of channel 150, measured from outer surface 145, is approximately equal to the depth of grooves 148 and 156.

When roller 112 is in contact with the base circle of the camshaft represented by line 152 (FIG. 4), the locations of annular grooves 148 and 156 in body 114 are such that annular grooves 148 and 156, never line up with, or extend past first bore end 136 of bore 134 or second bore end 138. Also, when roller 112 is in contact with the base circle of the cam shaft, the terminus point 154 of channel 150 remains in fluid communication with oil gallery 140. FIG. 5 depicts DRHVL 110' when roller 112 is in contact with the high lift portion of the camshaft represented by arc 155. As shown in this position, the location of annular grooves 148 and 156 in body 114 are such that annular grooves 148 and 156 never line up or extend into switching oil passage 142. Also, channel 150 remains in fluid communication with oil galley 140.

In use, lifter body 114 is reciprocated in a generally axial direction by rotary motion of a cam lobe of the camshaft associated with DRHVL 110. As lifter body 114 is moved by roller 112 it is displaced in a direction toward switching oil supply channel 142. The force applied to roller 112 by the cam lobe also displaces lifter body 114 in a generally radial direction within the lifter bore 134 of engine 132 and toward oil gallery 140. Thus, a small gap is created between lifter body 114 and lifter bore 134 at first bore end 136 during the lift event. Fluid, such as air, is drawn or flows into this gap. As lifter body 114 moves axially in the other direction, lifter body 114 is again displaced in a generally radial, but opposite direction within bore 134. At least some of the volume of air or other fluid that was drawn into lifter bore 134 at first bore end 136 during the lift event is trapped within the lifter bore 134 and is pumped or displaced upward toward switching channel 142. The trapped air, if allowed to advance in this direction, in the form of air bubbles, would enter switching channel 142 where the air would mix with the oil therein. As a result, substantially higher fluid flow and time would be required in order to compress the air ladened fluid for disengagement or uncompress the air laden fluid for re-engagement of deactivation pins 117. Such a condition would render the operation of deactivation pin assembly 116, and the coupling and decoupling of the DRHVL, less reliable and precise.

Annular grooves 148 and 156, in conjunction with channel 150 and oil gallery 140, remedies this problem. Pressurized oil contained in annular grooves 148 and 156 act as fluid seals and redirect the air bubbles away from switching channel 142. Because annular grooves 148 and 156 remain in fluid communication with oil gallery 140 at all times, continuous rings of oil are maintained at a relatively high pressure and serve to prevent air bubbles from getting past the annular grooves and reaching switching channel 142.

While the embodiment shown in FIGS. 4 and 5 discloses groove 156 to be in fluid communication with oil gallery 140 throughout the entire reciprocating range of the lifter via channel 156, since groove 156 is in direct communication with oil gallery 140 during at least part of the reciprocating range, it is understood that channel 156 can be omitted from the embodiment and still be within the scope of the invention.

While this invention has been described as having preferred designs, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A deactivation hydraulic valve lifter adapted to be positioned in a lifter bore formed in an engine, said deactivation hydraulic valve lifter comprising:

an elongate lifter body having a substantially cylindrical outer surface and an inner wall, said inner wall defining at least one pin chamber therein, said outer surface defining at least one annular groove in fluid communication with a high pressure oil gallery of said engine, said lifter body having a lower end configured for engaging cam of said engine, wherein said at least one annular groove is positioned between said lower end and said oil gallery so that a seal is formed between said outer surface of said lifter body and said lifter bore throughout the operation of the deactivation hydraulic valve lifter.

2. The deactivation hydraulic valve lifter of claim 1, wherein said at least one annular groove is fluidly connected to said oil gallery via a channel.

3. A deactivation hydraulic valve lifter, comprising:

an elongate lifter body having a substantially cylindrical outer surface and an inner wall, said inner wall defining at least one pin chamber therein, a plurality of annular grooves defined in said outer surface and being in fluid communication with a high pressure oil gallery of an engine, said lifter body having a lower end configured for engaging cam of said engine, wherein said plurality of annular grooves are fluidly connected to said oil gallery via at least one channel; and an elongate pin housing including a substantially cylindrical pin housing wall and pin housing bottom, said pin housing wall having an outer surface, said pin housing bottom defining a radially directed pin bore therethrough, said pin housing being substantially concentrically disposed within said inner wall of said lifter body such that said outer surface of said pin housing wall is adjacent to at least a portion of said inner wall of said lifter body.

4. The deactivation hydraulic valve lifter of claim 3, further comprising:

a pushrod engaging means for engaging a pushrod of said engine.

5. The deactivation hydraulic valve lifter of claim 4, further comprising:

a deactivation pin assembly disposed at least partially within said pin bore, said deactivation pin assembly including at least one pin member, said at least one pin member biased radially outward, at least a portion of said at least one pin member being disposed within a corresponding one of said at least one pin chamber to thereby couples said lifter body to said pin housing, said at least one pin member being configured for moving inward when said at least one pin chamber is pressurized, thereby retracting said at least one pin member from within a corresponding one of said at least one pin chamber and decoupling said lifter body from said pin housing.

* * * * *